US010152015B2

(12) United States Patent
Suzuki

(10) Patent No.: US 10,152,015 B2
(45) Date of Patent: Dec. 11, 2018

(54) OPEN/CLOSE MEMBER, HOLDING DEVICE AND IMAGE FORMING APPARATUS

(71) Applicant: CANON KABUSHIKI KAISHA, Tokyo (JP)

(72) Inventor: Takayuki Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/374,029

(22) Filed: Dec. 9, 2016

(65) Prior Publication Data

US 2017/0168449 A1 Jun. 15, 2017

(30) Foreign Application Priority Data

Dec. 10, 2015 (JP) ..... 2015-241403

(51) Int. Cl.
*G03G 21/16* (2006.01)

(52) U.S. Cl.
CPC ..... *G03G 21/1633* (2013.01)

(58) Field of Classification Search
CPC ..... G03G 21/1623; G03G 21/1633; G03G 21/1638
See application file for complete search history.

(56) References Cited

U.S. PATENT DOCUMENTS 2,950,139 A * 8/1960 Carbary ..... E05C 19/163 109/63.5
3,050,324 A * 8/1962 Faber ..... E05C 19/16 292/251.5
3,174,786 A * 3/1965 Wilson ..... E05C 19/16 292/251.5
3,562,850 A * 2/1971 Eliason ..... E05C 17/56 16/320
5,345,303 A * 9/1994 Hiroi ..... B65H 39/11 271/288
2005/0108945 A1* 5/2005 Wiemer ..... E05C 19/16 49/278
2005/0134668 A1* 6/2005 Takahashi ..... G03G 15/6529 347/156

(Continued)

FOREIGN PATENT DOCUMENTS

JP 8-240057 A 9/1996
JP 2003-13654 A 1/2003

(Continued)

*Primary Examiner* — Carla Therrien
(74) *Attorney, Agent, or Firm* — Fitzpatrick, Cella, Harper & Scinto

(57) ABSTRACT

A door holding device for apparatus includes an door mounted to the apparatus; an attraction member including a magnet and fixed the apparatus; an attracted member fixed on a mounting surface provided on the door and including a magnetic member when the door is in a closing position, the members being opposed and attracted to each other at an attraction plane when the door is closed; and a fastening member fastening the attracted member on the mounting surface. The mounting surface is provided opposed to the attracted member disposed in a side opposite from the plane, and the mounting surface and the plane are inclined, and wherein a fixed position of the attracted member to the mounting surface is adjustable in a direction perpendicular to an intersection line between planes parallel with the mounting surface and the attraction plane.

34 Claims, 7 Drawing Sheets

(56) References Cited

U.S. PATENT DOCUMENTS

| | | | | |
|---|---|---|---|---|
| 2010/0315658 | A1* | 12/2010 | Niikawa | G03G 21/1628 358/1.5 |
| 2015/0115630 | A1* | 4/2015 | Tarr | E05C 19/16 292/251.5 |

FOREIGN PATENT DOCUMENTS

| | | | |
|---|---|---|---|
| JP | 2012-7362 | A | 1/2012 |
| JP | 2012-202167 | A | 10/2012 |

* cited by examiner

OPEN/CLOSE MEMBER, HOLDING DEVICE AND IMAGE FORMING APPARATUS

FIELD OF THE INVENTION AND RELATED ART

The present invention relates to an open/close member holding device for holding a closed state of an open/close member such as an opening and closing door using an attraction force of a magnet, and an image forming apparatus such as a copying machine, a printer, a printing machine provided with the same.

Most of OA equipment and furniture are provided with an open/close member such as an opening and closing door. In the case of the OA equipment, for example, a front side outer casing is an opening and closing door to permit access to the inside of the equipment by a user or a service person, in many cases. Ordinarily, such an open/close member has an end portion rotatably fixed by a hinge mechanism, and the other end portion provided with an open/close member holding device to permit the open/close member to maintain a closed state.

As for such an open/close member, a widely used is a hook equation latch mechanism including a rotatable hook to be engaged with a fixed portion so as to maintain the closed state. However, for the open/close member which is frequently opened and closed, the opening and closing operation with the hook type latch mechanism is cumbersome. In addition, the hook type latch mechanism may be difficult to assuredly maintain the closed state of the open/close member because of distortion of the open/close member and/or limitation to a disposition position in the case of a relatively large open/close member. In many cases of the hook type latch mechanism used, it is difficult to adjust the positional deviation in the closed state between the open/close member and the fixing member with which the open/close member is unlockably engaged.

Under the circumstances, there is an open/close member holding device using an attraction force of a magnet to maintain the closed state to the open/close member. For example, Japanese Laid-open Patent Application 2003-13654 discloses a magnet catch to maintain the closed state of the opening and closing door or the like of the OA equipment. The magnet catch includes a magnet and is effective to retain (attract) an attracted member (member to be attracted) such as an iron plate by the magnetic force in the contacted or proximity state. Thus, in the open/close member holding device using the magnet catch, the magnet catch attracts the attracted member by the magnetic force, so that open/close member and the fixed member are maintained in the contact or proximity state (closed state). Japanese Laid-open Patent Application 2003-13654 discloses a magnet catch which can be provided without protrusion, and therefore, it is not hampering when the OA equipment or the like is used.

It is desirable that a relative positional relation between the open/close member and the fixed member (open/close member relative position) can be easily adjusted.

In the case of a relatively large open/close member, the open/close member may warp or distort, or the position thereof may involve a positional deviation. By this, a gap and/or step at the portion where the open/close member is in contact or proximity with the fixed member in the closed state may be deviated. If this occurs, the outer appearance is deteriorated in the case of a relatively large open/close member such as a front side outer casing of the OA equipment. Therefore, for the open/close member holding device for maintaining the closed state of the open/close member using the magnetic attraction described above, it is desirable that the open/close member relative position can be easily adjusted.

With the magnet catch disclosed in Japanese Laid-open Patent Application 2003-13654, such an adjustment is not easy. In the case that the magnet catch is fastened using the fastening member such as a screw, the screw may be loosened by the impact upon the opening and closing of the door. It would be considered that and the additional member is used to prevent the screw loosening, but doing so would result in an increase in cost.

SUMMARY OF THE INVENTION

It is a object of the present invention to provide an open/close member holding device and an image forming apparatus provided with the same, in which a relative positional relation between the open/close member and the fixed member can be easily adjusted with a simple structure, and the loosening of the fastening member for fixing the fixed member can be suppressed.

According to an aspect of the present invention, there is provided a holding device for holding an openable and closable open/close member for a main assembly of a apparatus, said holding device comprising an open/close member openably and closably mounted to the main assembly; an attraction member including a magnet and fixed on one of said open/close member and the main assembly; an attracted member fixed on a mounting surface provided on the other of said open/close member and the main assembly and including a magnetic member magnetically attractable by said magnet when said open/close member is in a closing position; wherein when said open/close member is in the closing position, said magnet and said magnetic member are opposed to each other in an opening and closing direction of said open/close member, and said attraction member and said attracted member are attracted to each other at an attraction plane; and a fastening member fastening said attracted member on said mounting surface, wherein said mounting surface is provided opposed to a surface of said attracted member disposed in a side opposite from said attraction plane, and said mounting surface and said attraction plane are inclined, and wherein a fixed position of said attracted member to said mounting surface is adjustable in a direction crossing with a line of intersection between a first plane parallel with said mounting surface and a second plane parallel with the attraction plane.

Further features of the present invention will become apparent from the following description of exemplary embodiments with reference to the attached drawings.

Figure 7:
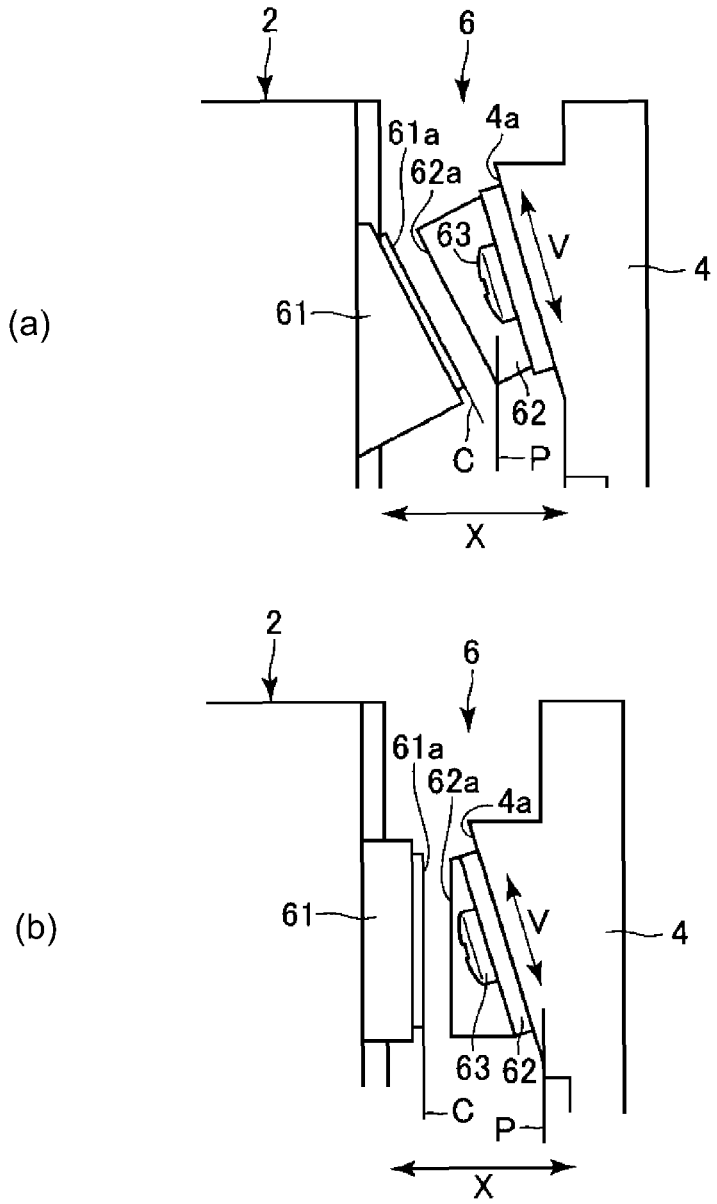

Part (a), (b) and (c) of FIG. 7 are side views of an image forming apparatus showing the an example of the open/close member holding device.

Figure 8:
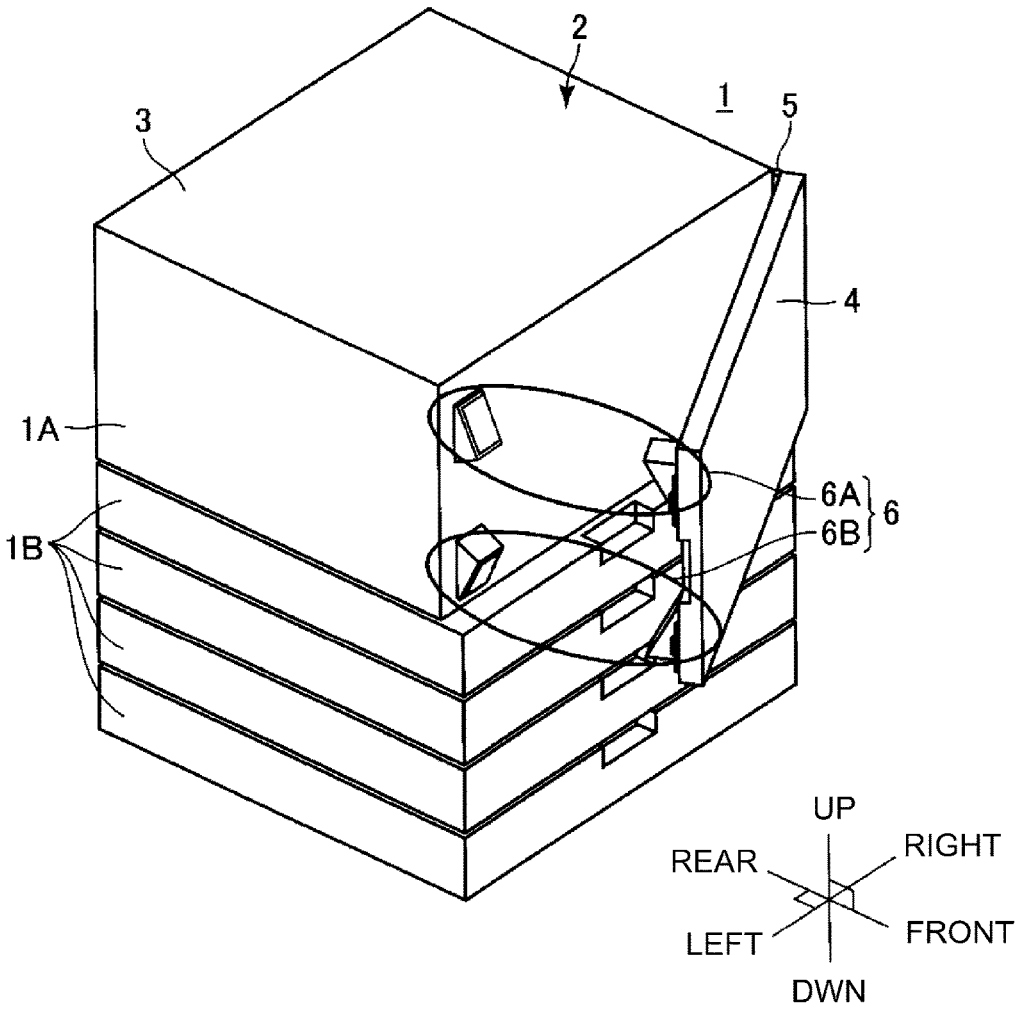

FIG. 8 is a perspective view of an image forming apparatus provided with an open/close member holding device according to a further embodiment.

DESCRIPTION OF THE EMBODIMENTS

An open/close member holding device and an image forming apparatus according to the present invention will be described in conjunction with the accompanying drawings.

[Embodiment 1]

Figure 1:
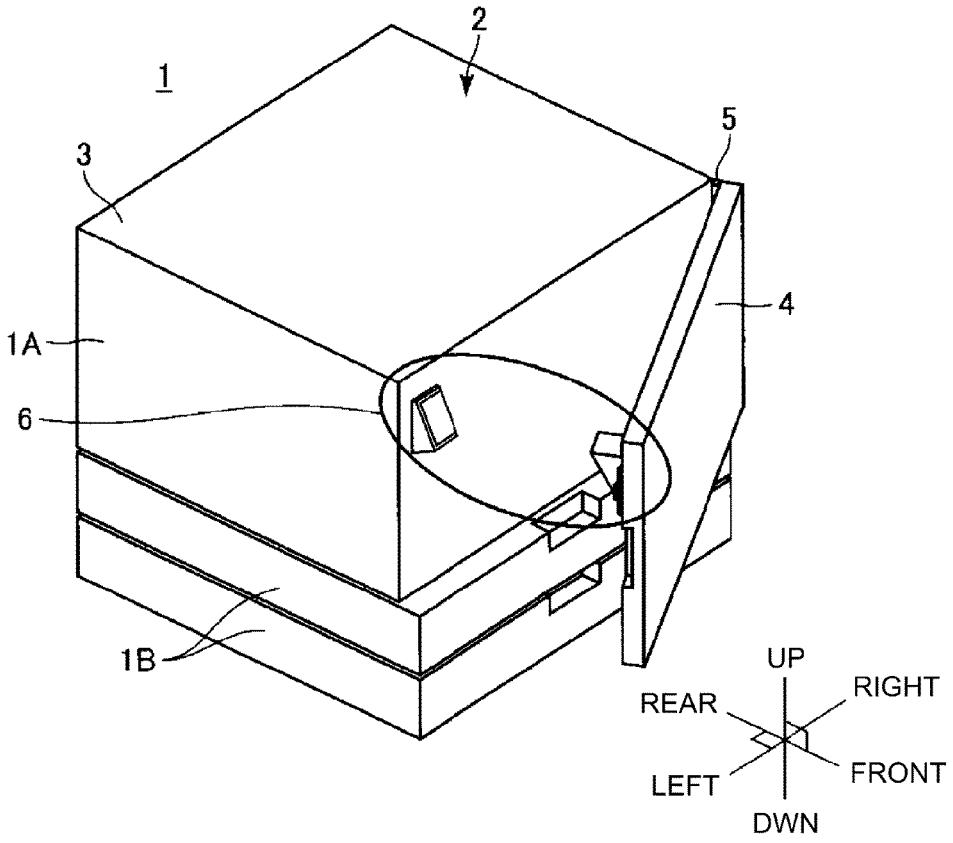
FIG. 1 is a perspective view of the outer appearance of an image forming apparatus.

1. Image Forming Apparatus:

In this embodiment, the present invention is applied to an image forming apparatus which is an example of OA equipment. FIG. 1 is a perspective view illustrating an outer appearance of an image forming apparatus 1 according to an embodiment of the present invention.

The image forming apparatus 1 includes a printer station 1A and a recording material feeding portion 1B for accommodating recording materials such as sheets of paper and feeding the recording materials to the printer station 1A. The printer station 1A includes an image forming station (unshown) for forming an image on the recording material through an electrophotographic type process, for example. The printer station 1A is covered by outer casing 3 to protect the inside devices and to shut the noise produced by the inside devices.

Figure 2:
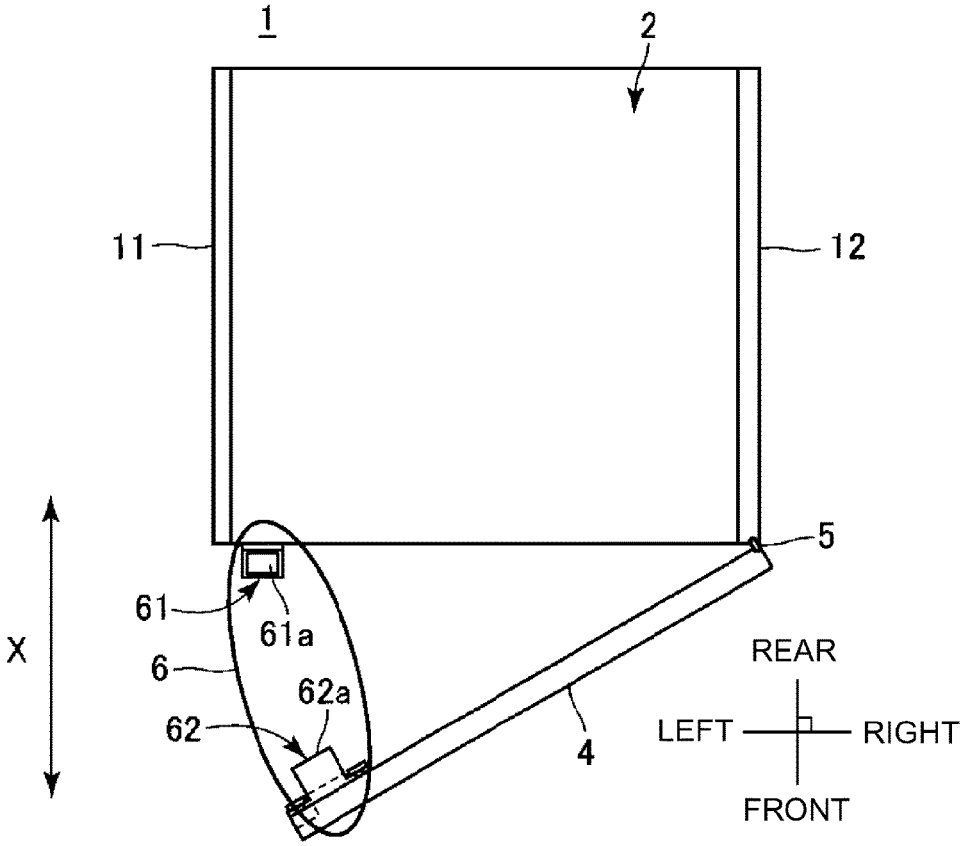
FIG. 2 is a top plan view of the image forming apparatus.

In FIG. 1, the printer station 1A is schematically illustrated as a substantially cubic member configuration, of which an upper surface, a left surface and a front surface appear. The terms upper and lower, front and rear and left and right are as shown in FIG. 2. The image forming apparatus 1 is usually placed such that the vertical direction shown in FIG. 1 is the direction of gravity.

In this embodiment, the outer casing 3 mainly comprises synthetic resin material produced by an injection molding. The outer casing 3 may be made of a material other than synthetic resin material, that is, a metal or the like steel, for example. In this embodiment, the outer casing 3 is provided to cover all the sides except for the recording material feeding portion (1B) side of the printer station 1A (lower side). The outer casing 3 is mounted to a frame (unshown) supporting inside devices of the printer station 1A. At least a part of the printer station 1A and the recording material feeding portion 1B may be covered by a common outer casing. In accordance with the above-described positional relationships, the portions of the outer casing 3 at the front side, the left side and the right side of the printer station 1A are called "front cover", "left cover" and "right cover", respectively.

At least a part of outer casing 3 can be opened and closed to permit access into the printer station 1A. For the purpose of maintenance of the printer station 1A or sheet jam clearance operation in the printer station 1A, the openable and closable part of the outer casing 3 is opened and closed by the operator.

In this embodiment, the present invention is applied to the front cover 4 which covers a relatively wide range of the printer station 1A and which is most frequently accessed by the operator, and the description of the open/close member will be made taking such a part as an example. The front cover 4 is an example of the open/close member, and the portion (main assembly) 2 other than the front cover 4, of the image forming apparatus 1 (particularly, printer station LA) is an example of the fixed member.

In this embodiment, the front cover 4 is mounted on the main assembly 2 by a hinge mechanism 5 at the right side end portion so as to be opened and closed. The hinge mechanism 5 permits rotation of the front cover 4 about a rotation axis extending substantially in parallel with the direction of gravity to open and close the front side of the main assembly 2. The front cover 4 is maintained in the closed state by the latch mechanism 6 as an open/close member holding device provided at the left side end portion. For accessing the inside of the main assembly 2, the latch mechanism 6 is released, and the front cover 4 is pulled out to rotate it about the rotational center using the hinge mechanism 5. By this, the inside of the main assembly 2 can be accessed. Thus, it is not necessary to remove the cover, and no large space that is otherwise required to place the removed cover is necessary.

FIG. 2 is a top plan view of the image forming apparatus. The front cover 4 is at a position of the image forming apparatus 1 that is most easily seen by the user. Therefore, if there is a gap and/or step between the front cover 4 and the other outer casing 3 (left cover 11 and/or right cover 12, for example) adjacent thereto, the outer appearance of the image forming apparatus 1 is deteriorated. Therefore, in this embodiment, as will be described in detail, the latch mechanism 6 is provided with a mechanism for adjusting the open/close member relative position between the front cover 4 and the other outer casing 3 adjacent thereto.

That is, the fixed member and the open/close member are provided at one end portion of the open/close member with respect to a direction, and the open/close member holding device including an attraction member and an attracted member (member to be attracted) which will be described hereinafter is provided at the other end portion with respect to the same direction.

2. Latch Mechanism:

In this embodiment, the front cover 4 is rotatable from the closed state position frontwardly and substantially horizontally about a substantially vertical hinge axis of the hinge mechanism 5 provided at the right side. The front cover 4 is maintained in the closed state by the latch mechanism 6 as the open/close member holding device provided at the left side end.

In this embodiment, the latch mechanism 6 functions to maintain the closed state of the front cover 4 using an attraction force of a magnet. The latch mechanism 6 comprises an attraction member 61 provided on a main assembly (2) side and an attracted member 62 provided on the front cover (4) side.

The attraction member 61 may be any if it includes a magnet to attract the attracted member 62 by the magnetic force thereof, thereby retaining the closed state of the front cover 4. In this embodiment, a so-called magnet catch is used to as the attraction member 61 for attracting the attracted member by the magnetic force. The magnet catch generally comprises a magnet (permanent magnet), a yoke of a material (ferromagnetic material) magnetizable by the magnetic force generated by the magnet, and a case accommodating them. The yoke contacts the magnet, and a part thereof is projected out of the case or covered by the case. The yoke projected out of the case or an attraction portion of the case adjacent to the yoke inside thereof magnetically attracts the attracted member. Various types of magnet catch are commercially available, and are usable in the present invention. The attraction member 61 may be fixed on the main assembly 2 directly or through a holder. In this embodiment, the attraction member 61 is fixed on the main assembly 2 so as to uncover an attraction portion 61*a* frontwardly.

At least an attracted portion 62*a* of the attracted member 62 attracted by the attraction member 61 is made of a material which can be confined by the magnetic force, that is, the material (ferromagnetic member) magnetizable by the magnetic force generated by the attraction member 61. In this embodiment, the entirety of the attracted member 62 is made of ferromagnetic member such as steel, ferrite stainless steel or the like. The attracted member 62 is fixed on the front cover 4 at the position where the attracted portion 62*a* is opposed to the attraction portion 61*a* in the closed state of the front cover 4. As will be described in detail hereinafter, the attracted member 62 is movable vertically to adjust the position thereof.

Figure 3:
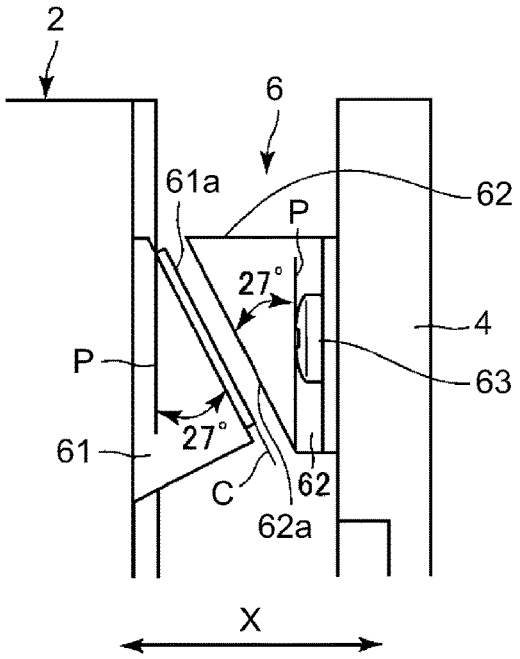
FIG. 3 is a side view of the image forming apparatus adjacent to an open/close member holding device.

FIG. 3 is a side view of the neighborhood of the latch mechanism 6 as seen from the left side of the image forming apparatus 1. Here, a moving direction of the front cover 4 relative to the main assembly 2 immediately before the abstraction of the attracted member 62 by the attraction member 61 (or immediately after release) is called "opening and closing direction". In this embodiment, the opening and closing a direction of the front cover 4 is substantially parallel with the front and rear direction of the image forming apparatus 1 indicated by an arrow X in the Figure. As described hereinbefore, in this embodiment, the front cover 4 is rotatable by the hinge mechanism 5, but the moving direction of the front cover 4 relative to the main assembly 2 immediately before the attraction can be approximated as a linear direction. The same applies to the case where the hinge mechanism 5 is disposed at the position other than the right side end portion, that is, a lower side end portion, for example, in which case the front cover 4 is rotatable about a rotation axis substantially parallel with the horizontal direction. In this embodiment, a plane substantially perpendicular to the opening and closing direction of the front cover 4 is substantially parallel with the direction of gravity.

As shown in FIG. 3, the attraction portion 61*a* is positioned at a angle of approx. 27° relative to the plane P substantially perpendicular to the opening and closing direction X. In this embodiment, the attraction portion 61*a* is directly obliquely upwardly at the angle. In addition, similarly to the attraction portion 61*a*, the attracted portion 62*a* is positioned at the angle of substantially 27° relative to the plane P substantially perpendicular to the opening and closing direction X. Particularly, in this embodiment, the attracted portion 62*a* is detected obliquely downwardly at the angle.

Figure 4:
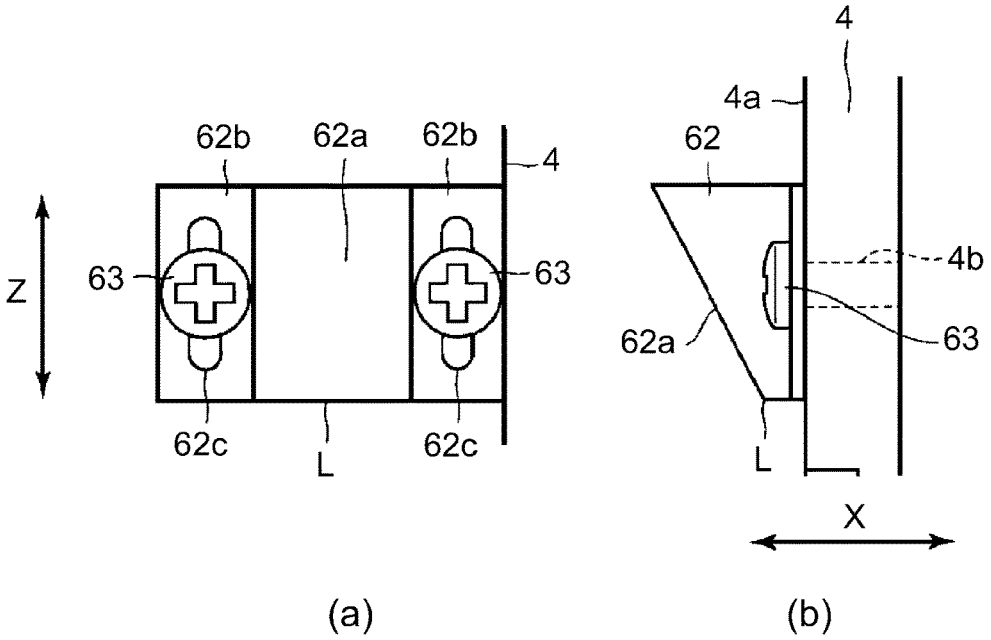
FIG. 4 is a front view and a side view of an attracted member.

3. Adjusting Mechanism for Open/Close Member Relative Position:

FIG. 4 shows details of the attracted member 62 of the front cover 4, part (a) of FIG. 4 is a view as seen from the rear side, and part (b) of FIG. 4 is a side view as seen the left side.

When the open/close member relative position such as the gap and/or the step between the front cover 4 and the outer casing 3 (left cover 11 and/or right cover 12, for example) adjacent thereto in the closed state of the front cover 4 is not proper, an adjustment is preferably made. When the open/close member relative position is not proper, the outer appearance of the image forming apparatus 1 is deteriorated, and in addition, the operation noise inside the image forming apparatus 1 may leak, and/or a malfunction of a interlocking switch synchronized with the opening and closing of the front cover 4 may result. Therefore, in the latch mechanism 6 of this embodiment, the open/close member relative position between the front cover 4 and the main assembly 2 can be adjusted by adjusting the position of the attracted member 62 on the front cover 4 Particularly, in this embodiment, the open/close member relative position between the front cover 4 and the outer casing 3 adjacent thereto with respect to the opening and closing direction X.

As shown in FIG. 4, the attracted member 62 includes the attracted portion 62*a* and flange portions 62*b*, 62*b* provided at the both sides of the attracted portion 62*a*. In this embodiment, the attracted portion 62*a* and the flange portions 62*b*, 62*b* are integrally formed. In this embodiment, the attracted portion 62*a* has a substantially rectangular surface having an upper side and a lower side which are substantially horizontal. The attracted portion 62*a* is projected beyond the flange portions 62*b*, 62*b* and provides the above-described angle. The flange portions 62*b*, 62*b* are provided with elongated and substantially parallel screw fixing holes 62*c*, 62*c* extending in the vertical direction indicated by an arrow Z in the Figure, respectively. The attracted member 62 is fixed on the mounting surface 4*a* of the front cover 4 by fixing screws 63, 63 as releasable fixed devices threading into the screw holes 4*b*, 4*b* of the front cover 4 through the screw fixing holes 62*c*, 62*c*.

In this embodiment, the mounting surface 4*a* of the front cover 4 on which the attracted member 62 is mounted is substantially parallel with the direction of gravity and is substantially parallel with the plane substantially perpendicular to the opening and closing direction X in the closed state of the front cover 4. The position of the attracted member 62 on the front cover 4 can be adjusted by moving the attracted member 62 in the vertical direction Z along the elongated screw fixing holes 62*c*, 62*c*. The screw fixing holes 62*c*, 62*c* are so formed that even if the fixing screws 63, 63 are fixed at any position with respect to the longitudinal direction, at least a part of the attracted portion 62*a* opposes at least a part of the attraction portion 61*a* to permit the attraction of the attracted member 62 by the attraction member 61. In this embodiment, the attracted member 62 is fixed at two positions, which, however, is not restrictive to the present invention, and it may be fixed at one position, or three or more positions.

The position of the attracted member 62 can be adjusted at the time of mounting, and after it is mounted, as well. That is, the fixing screws 63, 63 are loosened, and the attracted member 62 is moved in the vertical direction Z. Then, the attracted member 62 is moved to the proper position, and the fixing screws 63, 63 are tightened to fix the attracted member 62 to the front cover 4.

The attraction portion 61*a* and the attracted portion 62*a* are inclined relative to the plane P substantially perpendicular to the opening and closing direction X at approx. 27°. Therefore, an attraction plane C between the attraction member 61 and the attracted member 62 (a contact surface between the attraction portion 61*a* and the attracted portion 62*a* is inclined relative to the plane P substantially perpendicular to the opening and closing direction X at approx. 27°. When the attraction portion 61*a* and the attracted portion 62*a* are continuous flat surfaces having predetermined areas (including linear or spot-like surfaces having a predetermined widths), respectively, the attraction plane C is the plane of the surfaces of the contact or proximity portions thereof. When at least one of the attraction portion 61*a* and the attracted portion 62*a* are provided by a plurality of spaced surfaces, lines or spots, the plane formed by connecting the contact portions or proximity portions of the attraction portion 61*a* and the attracted portion 62*a* is the attraction plane C. In this embodiment, the attraction portion 61*a* and the attracted portion 62*a* are continuous flat surfaces, respectively.

In addition, in this embodiment, the mounting surface 4*a* of the front cover 4 on which the attracted member 62 is mounted is substantially parallel with the plane P substantially perpendicular to the opening and closing direction X in the closed state of the front cover 4. That is, the mounting surface 4*a* is inclined relative to the attraction plane C at approx. 27°. The mounting surface 4*a* of the attracted member 62 is movable in the vertical direction. In other words, in this embodiment, the position of the attracted member 62 is adjustable by moving it in the plane substantially perpendicular to the opening and closing direction X. More particularly, the attracted member 62 is movable in a direction substantially perpendicular to a line of intersection (a substantially horizontal bottom side L of the attracted portion 62*a* of FIG. 4, in this embodiment) between the attraction plane C and a plane P substantially perpendicular to the opening and closing direction X. The attracted member 62 may be movable in any direction in a flat surface substantially perpendicular to the opening and closing direction X, if the direction crosses with the line of intersection. However, from the standpoint of easiness in the setting of the movement distance of the attracted member 62 corresponding to the adjustment amount of the open/close member relative position, the attracted member 62 is preferably movable in the direction (vertical direction in this embodiment) substantially perpendicular to the intersection line.

Figure 5:
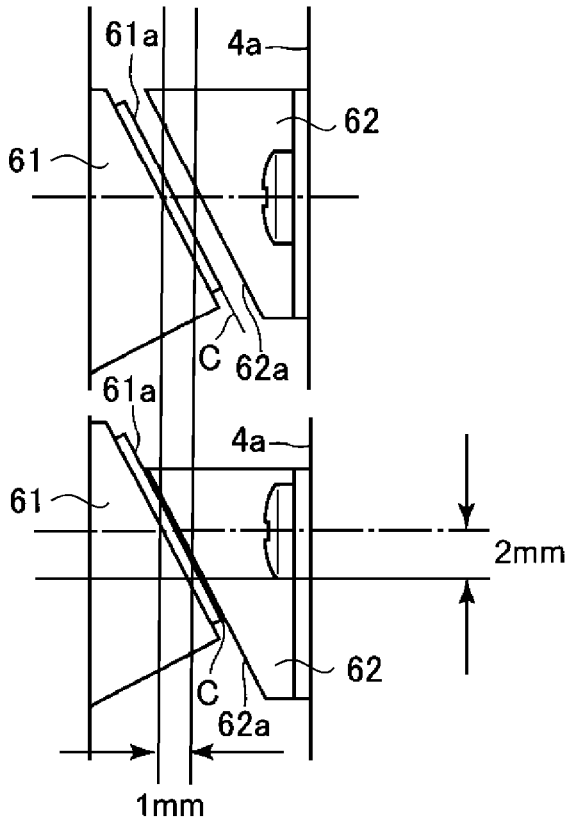
FIG. 5 is a side view showing an adjustment method for an open/close member relative position.

With the above-described structures and arrangement, as shown in FIG. 5, when the attracted member 62 is moved vertically (Z) by 1 mm, for example, the attracted portion 62*a* advances or retracts in the opening and closing direction X by 0.5 mm relative to a certain point on the attraction portion 61*a*. Since the position of the attraction member 61 is fixed, and the attracted portion 62*a* is attracted to the attraction portion 61*a* irrespective of the position of the attracted member 62 in the vertical direction Z, the front cover 4 having the attracted member 62 advances and retracts in the opening and closing direction X by 0.5 mm.

A case will be considered in which the gap between the front cover 4 and the main assembly 2 (left cover 11, for example) is smaller than the proper value by 1 mm in the closed state of the front cover 4, for example. In this case, the attracted member 62 is moved downwardly by 2 mm. Then, the attracted portion 62*a* move by 1 mm in a direction away from the main assembly 2 along the opening and closing direction X relative to a certain point on the attraction portion 61*a*. When the front cover 4 closed in the state, the front cover 4 is fixed 1 mm in front of the position before the adjustment of the position of the attracted member 62. Thus, the gap between the front cover 4 and the main assembly 2 in the closed state of the front cover 4 can be made proper. When the gap between the front cover 4 and the main assembly 2 in the closed state of the front cover 4 is larger than the proper level, the operations is similar, more particularly, the attracted member 62 is moved upwardly.

In this embodiment, the inclination angle of the attraction surface C is approx. relative to the opening and closing direction X, by which the ratio of the movement distance of the attracted member 62 to the adjustment amount of the gap is 1:2. However, the inclination angle is not limited to the specific example. If the finer adjustment than in this embodiment is desired, the inclination angle is reduced. By doing so, the amount of the advancement and retraction movement of the front cover 4 relative to the movement distance of the attracted member 62 is small, and therefore, a finer adjustment can be accomplished. On the contrary, a rougher adjustment than in this embodiment is enough, the inclination angle may be increased. Typically, the inclination angle is preferable if it is not less than 5° and not more than 45° from the standpoint of the easiness of the adjustment.

Figure 6:
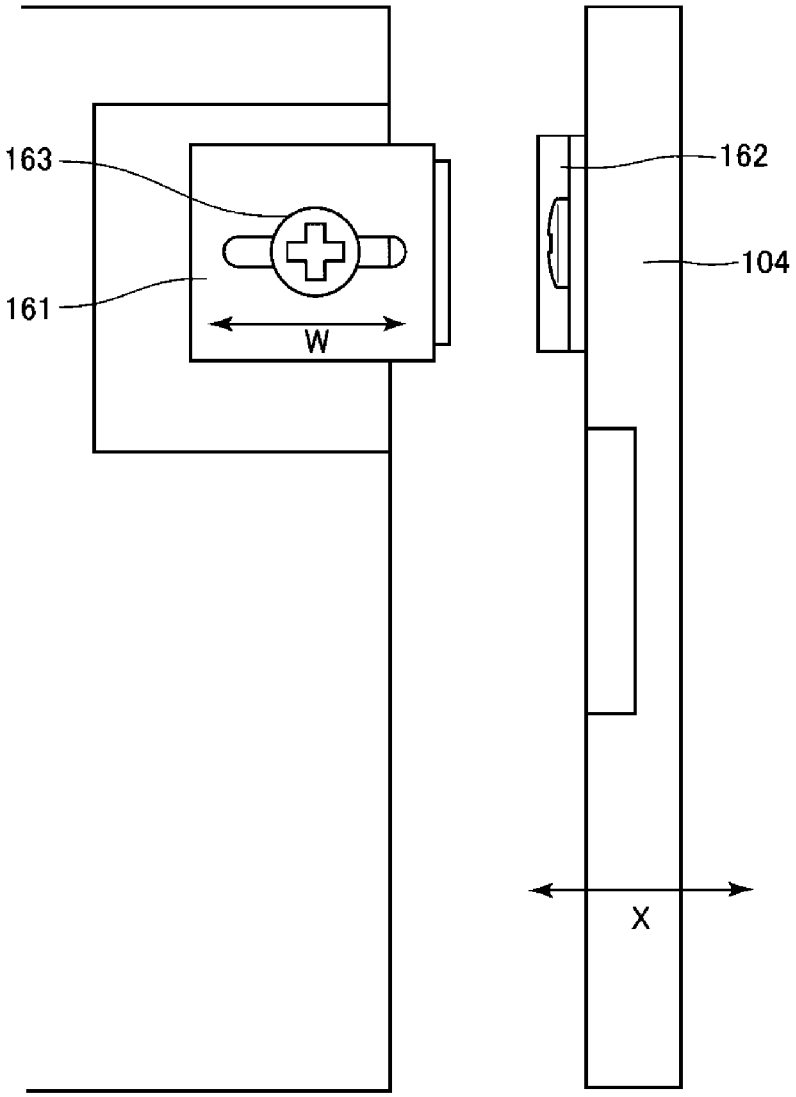
FIG. 6 is a side view an image forming apparatus showing a fixing method for a conventional open/close member holding device.

4. Fixing Direction:

The necessity for the alignment of the outer casing of the OA equipment or the like frequently arises when the gap and/or step between the opening and closing outer casing and another outer casing in the opening and closing direction of the outer casing as in the case of the front cover 4 of this embodiment. When the gap and/or step in the opening and closing direction of the front cover of the image forming apparatus as in this embodiment is made adjustable, the following structures will be ordinarily employed. That is, as shown in FIG. 6, for example, a magnet catch 161 is made movable substantially in the same direction as the opening and closing direction X of the front cover 104, as indicated by an arrow W in the Figure. Therefore, the magnet catch 161 is fixed in a direction perpendicular to the opening and closing direction X of the front cover 104 (substantially perpendicular in the shown in example) at the peripheral portion of the opening, that is, the outer surface, the inner side surface (left side in that shown in example) of the main assembly 102. The fixing method ordinarily uses a screw 163 since then repeated use is possible. With the adjusting direction for the position of the magnet catch 161, the screw 163 may be loosened by the repeated opening and closing operations. This is because the fastening with the screw is very strong with respect to the axial direction of the screw, but the confining force is provided only by the frictional force at the seat of the screw with respect to the direction crossing with the axial direction. The open/close member relative position is preferably not easily deviates against the repetition of the opening and closing of the open/closing member after the adjustment is once carried out. For example, with the open/close member rotatably supported using the hinge mechanism, the deviation of the open/close member relative position does not easily occur at the side where the hinge mechanism is provided. However, at the opposite side, the impact is applied in the opening and closing direction of the open/close member at the time of the opening and closing operations, and therefore, the repetition of the opening and closing operations tended to cause the deviation of the open/close member relative position. Therefore, the open/close member holding device for holding the closed state of the open/close member using the attraction force of the magnet preferably does not easily deviate the open/close member relative position even when the opening and closing operation of the open/close member is repeated.

As contrasted to this example, the adjusting direction of the position of the attracted member 62 substantially perpendicular to the opening and closing direction X of the front cover 4 in this embodiment. In other words, the fixing direction of the fixing screw 63 is substantially the same as the opening and closing direction X of the front cover 4. Therefore, the force applied to the fixing screw 63 by the opening and closing of the front cover 4 is in the axial direction of the fixing screw 63, and therefore, the deviation of the attracted member 62 by the repetition of the opening and closing operations of the front cover 4 is suppressed.

In this embodiment, the magnet catch as the attraction member 61 is inserted in the frame of the main assembly 2 in the direction substantially perpendicular to the attraction surface C so as to be substantially immovable. The fixing method may be another, and may use snap fit type with an elastically deformable engaging portion, for example.

Therefore, even when the opening and closing operations of the front cover 4 are repeated, the position of the attraction member 61 is substantially not deviated.

With the above-described conventional adjusting direction, the magnet catch a fixed on the peripheral portion of the opening which is the outer surface or the inner side surface of the main assembly, for example, to permit access of a tool to the screw 163. Therefore, the mounting position of the magnet catch is limited. On the other hand, with the fixed directions of the attraction member 61 and the attracted member 62 of this embodiment, the positions of thereof are not limited to such, and therefore, the latitude of the position of the latch mechanism 6 is increased.

In the case of a relatively large open/close member such as the front cover 4 in this embodiment, it is relatively difficult to maintain the constant gap relative to the main assembly 2 at the positions of the top end portion and the bottom end portion in the side opposite from the hinge mechanism 5. In view of this, in this embodiment, the latch mechanism 6 is disposed in an upper side beyond a center portion with respect to the vertical direction at the left side end portion of the front cover 4, but the latch mechanism 6 may be disposed substantially in the center portion with respect to the vertical direction at the left side of the front cover 4. By doing so, the gaps can be easily maintained constant in the top end portion and the bottom end portion of the front cover 4.

In this embodiment, the attraction member 61 and the attracted member 62 are arranged such that the attraction portion 61*a* and the attracted portion 62*a* face upwardly and downwardly, respectively. That is, in this embodiment, the attraction member 61 and the attracted member 62 are arranged such that the line of intersection between the plane P substantially perpendicular to the opening and closing direction X and the attraction plane C is substantially parallel with the horizontal direction. However, the present invention is not limited to this specific example, and the attraction member 61 and the attracted member 62 may be arranged such that attraction portion 61*a* and the attracted portion 62*a* are directed to the right and left, respectively (the line of the intersection is substantially parallel with the direction of gravity). In addition, the arrangement may be between this example and the embodiment (the line the intersection crosses with the direction of gravity and with the horizontal direction).

As described in the foregoing, in this embodiment, the attraction plane C between the attraction member 61 and the attracted member 62 is inclined relative to the plane P substantially perpendicular to the opening and closing direction X. The attracted member 62 is movable in the plane crossing with the opening and closing direction X to adjust the position. Particularly, in this embodiment, the attracted member 62 is movable in the plane substantially perpendicular to the opening and closing direction X to adjust the position. By doing so, the open/close member relative position between the front cover 4 and the main assembly 2 can be easily adjusted with a simple structure. In this embodiment, the fixing direction (fastening direction of the fixing screw 63) of the position-adjustable attracted member 62 is substantially the same as the opening and closing direction. Therefore, even when the opening and closing operations of the front cover 4 are repeated, the positional deviation of the attracted member 62 does not easily occur. In addition, the access of the tool to the fixing screw 63 is relatively easy, and therefore, the position adjustment and the fixed of the attracted member 62 is relatively easy. Particularly, in this embodiment, the position-adjustable attracted member 62 is provided on the openable and closable (movable) front cover 4. By this, the adjustment of the open/close member relative position is further easy. In addition, with the fixed direction of the attraction member 61 and the attracted member 62 as in this embodiment, the latch mechanism 6 can be disposed at the position not influenced by the configuration and/or structure of the main assembly 2.

In this manner, according to this embodiment, the relative positional relation between the open/close member and the fixed member can be easily adjusted with a simple structure. More particularly, according to this embodiment, the simplification of the mechanism for adjusting the relative positional relationship between the open/close member and the fixed member, the easy adjusting operation, the suppression of the deviation of the positional relation after the adjustment, and the enhancement of the latitude of the positions of the open/close member holding device can be accomplished.

[Embodiment 2]

Another embodiment of the present invention will be described. In this embodiment, the fundamental structures of the image forming apparatus and the open/close member holding device are the same as those of Embodiment 1. In the description of this embodiment, the same reference numerals as in Embodiment 1 are assigned to the elements having the corresponding functions in this embodiment, and the detailed description thereof is omitted for simplicity.

In Embodiment 1, the mounting surface 4*a* on which the attracted member 62 is mounted it substantially aligned with the plane substantially perpendicular to the opening and closing a direction X, but the mounting surface 4*a* may be inclined relative to the plane P substantially perpendicular to the opening and closing direction X.

For example, as shown in part (a) of FIG. 7, the mounting surface 4*a* may be inclined relative to the plane P substantially perpendicular to the opening and closing direction X in the same direction as the attraction plane C at a angle different from the inclination of the attraction plane C. In this case, the mounting surface 4*a* is inclined relative to the plane substantially parallel with the attraction plane C, similarly to Embodiment 1.

As described, typically, the mounting surface 4*a* may be inclined such that the line of intersection between the plane P substantially perpendicular to the opening and closing direction X and the attraction plane C is substantially aligned with the line of intersection between the plane P substantially perpendicular to the opening and closing direction X and the mounting surface 4*a*. In such a case, as shown by an arrow V in the Figure, the position of the attracted member 62 it adjusted by moving on the mounting surface 4*a* inclined relative to the plane P substantially perpendicular to the opening and closing direction X in the direction substantially parallel with the mounting surface 4*a*. More particularly, the attracted member 62 is moved on the mounting surface 4*a* in the direction crossing with the line of the intersection (substantially perpendicular direction, typically) between the plane P substantially perpendicular to the opening and closing direction X and the attraction plane C to adjust the position thereof.

On the other hand, and shown in part (b) of FIG. 7, for example, when the mounting surface 4*a* is inclined relative to the plane P substantially perpendicular to the opening and closing direction X, the attraction plane C and the plane P substantially perpendicular to the opening and closing direction X may be substantially parallel with each other. In this case, too, the attracted member 62 is moved on the mounting surface 4*a* inclined relative to the plane P substantially perpendicular to the opening and closing direction X in the plane substantially parallel with the mounting surface 4*a*. By this, the position of the mounting surface 4*a* relative to a certain point on the attraction portion 61*a* can be adjusted, and therefore, the same effects as those with the structure in which the attraction plane C is inclined relative to the plane P substantially perpendicular to the opening and closing direction X can be provided. In other words, the mounting surface 4*a* may be inclined relative to the attraction plane C and relative to the plane P substantially perpendicular to the opening and closing direction X, in which the position can be adjusted by moving the attracted member 62 in a plane substantially in parallel with the mounting surface 4*a*.

Even if, for example, a sufficient space for opening and closing of the front cover 4 is not provided so that the space necessary for the access to the fixing portion of the fixing screw 63 is not sufficient, the access is made relatively easy by inclining the mounting surface 4*a*.

[Embodiment 3]

A further embodiment of the present invention will be described. In this embodiment, the fundamental structures of the image forming apparatus and the open/close member holding device are the same as those of Embodiment 1. In the description of this embodiment, the same reference numerals as in Embodiment 1 are assigned to the elements having the corresponding functions in this embodiment, and the detailed description thereof is omitted for simplicity.

In Embodiment 1, the open/close member holding device 6 comprises one latch mechanism, but in this embodiment, the open/close member holding device 6 comprises at least two latch mechanisms.

FIG. 8 is a perspective view of an outer appearance of the image forming apparatus 1 according to this embodiment. As shown in FIG. 8, in this embodiment, the image forming apparatus 1 is provided with one latch mechanism 6A, 6B in each of the upper side and the lower side of the center portion with respect to the vertical direction at a left-hand end portion of the front cover 4. The upper side latch mechanism 6A and the lower side latch mechanism 6B have the structures similar to the latch mechanism 6 of Embodiment 1. In this embodiment, however, the facing directions of the attraction plane C between the attraction member 61 and the attracted member 62 is different between the upper side latch mechanism 6A and the lower side latch mechanism 6B.

In this embodiment, the inclining directions of the attraction plane C in the upper side latch mechanism 6A and the lower side latch mechanism 6B relative to the plane P substantially perpendicular to the opening and closing direction X are symmetrical with each other with respect to a horizontal line. In this embodiment, the attraction portion 61*a* of the upper side latch mechanism 6A faces upwardly, and the attracted portion 62*a* faces downwardly, and the inclination angle of the attraction plane C relative to the plane P is approx. 27°. The attraction portion 61*a* of the lower side latch mechanism 6B faces downwardly, and the attracted portion 62*a* faces upwardly, and the inclination angle of the attraction plane C relative to the plane P is approx. 27°. That is, the attraction planes C between the respective attraction members 61 and the attracted members 62 of the upper side latch mechanism 6A and the lower side latch mechanism 6B are inclined in the opposite directions from each other relative to the plane P substantially perpendicular to the opening and closing direction X. In this manner, in this embodiment, two sets of the attraction member and the attracted member, and the attraction planes between the attraction members and the attracted members in the sets are inclined in the opposite directions to each other, relative to the plane substantially parallel with the opening and closing direction of the open/close member.

In the case of a relatively large open/close member such as the front cover 4 in this embodiment, it is relatively difficult to maintain the constant gap relative to the main assembly 2 at the positions of the top end portion and the bottom end portion in the side opposite from the hinge mechanism 5. However, by the provision of the latch mechanisms 6A, 6B in the neighborhood of the top end portion and the bottom end portion as in this embodiment, the gap can be adjusted relative to the main assembly 2 at each of the top end portion and the bottom end portion. In addition, by the provision of the upper side latch mechanism 6A and the lower side latch mechanism 6B with the above-described inclinations, the front cover 4 is not moved even when the front cover 4 is pressed with a strong force from the outside. Therefore, the front cover 4 can be maintained with further assurance.

In the case that the mounting surface 4*a* is inclined relative to the plane P substantially perpendicular to the opening and closing direction X as in Embodiment 2, the mounting surfaces 4*a* of the attraction members and the attracted members in the sets are inclined in the directions opposite to each other relative to the plane P substantially perpendicular to the opening and closing direction X. By this, the same effects of this embodiment are provided.

[Others]

The present invention has been described with respect to specific examples, but the present invention is not limited to such examples.

In the foregoing embodiments, the attraction member is provided on the fixed member (main assembly), and the attracted member is provided on the open/close member (front cover). However, the present invention is not limited to such examples, and the attraction member may be provided on the open/close member, and the attracted member is provided on the fixed member. In other words, it will suffice if the open/close member holding device comprises the attraction member including the magnet and the attracted member magnetically attractable to the attraction member, and one of the attraction member and the attracted member is provided on the fixed member, and the other is provided on the open/close member. In the foregoing embodiments, such one of the attraction member and the attracted member that is used for the position adjustment (attracted member in the foregoing embodiments) is provided on the open/close member. This is advantageous in that the adjusting operation is easy, but such one of the attraction member and the attracted member that is adjusted in the position may be provided on the fixed member, as desired. Such an arrangement is preferable in the case that the portion not frequently adjusted or not desirably accessed by the user is to be adjusted.

In the foregoing embodiments, the position of the attracted member is adjustable, but the position of the attraction member may be adjustable instead. In addition, both of the attraction member and the attracted member may be made the adjustable. In other words, it will suffice if at least one of the attraction member and the attracted member is adjustable. Referring to the above-described embodiments, the attraction member 61 may be made movable in the vertical direction similarly to the attracted member 62. In the case that both of the attraction member and the attracted member are adjustable, a convenient one of them may be adjusted, or the adjustment the amount of the opening and closing portion relative position can be made larger by adjusting both. When one of the attraction member and the attracted member is made adjustable, the adjustable one is typically mounted on the open/close member, but may be mounted on the fixed member. In addition, by making the fixing direction of at least one of the attraction member and the attracted member substantially the same as the opening and closing direction of the open/close member, the deviation of the position can be suppressed.

In the foregoing embodiments, the open/close member is rotatably supported by the fixed member using the hinge mechanism, but the present invention is not limited to such an example. For example, the open/close member may be mountable to and dismountable from the fixed member.

In the foregoing description of the positions (angles), the substantial parallelism includes the exactly parallel arrangement and not exactly parallel arrangement within the tolerable deviation or tolerance, for example within the range of approx. ±5°. The same applies to the same direction, and the same direction includes the exactly the same direction and the deviated direction within the similar tolerance.

According to this embodiment, the relative positional relationship between the open/close member and the fixed member can be easily adjusted with a simple structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-241403 filed on Dec. 10, 2015, which is hereby incorporated by reference herein in its entirety.

What is claimed is:

1. A holding device comprising:

a main assembly including an outer casing having a cover;

an open/close member rotatably mounted on said main assembly at a position adjacent to said cover to open and close said main assembly; and a closed state maintaining mechanism including:

a magnet provided on one of said main assembly and said open/close member; and an attracted member mounted, at a mounting position, on a mounting surface of the other one of said main assembly and said open/close member, wherein said magnet has a surface facing said attracted member to maintain a closed state of said open/close member relative to said main assembly by said magnet attracting and contacting said attracted member, wherein the mounting position of said attracted member is adjustable between a plurality of positions, said attracted member being adjustable in a crossing direction, the crossing direction being a direction (i) crossing a direction which is perpendicular to the surface of said magnet and (ii) crossing a direction which is perpendicular to the mounting surface, and wherein said mounting surface is inclined relative to the surface of said magnet such that a relative positional relation between said cover and said open/close member in the closed state is different based on the mounting position of said attracted member.

2. A holding device according to claim 1, wherein said attracted member is provided with an opening elongated in the crossing direction, and said mounting surface is provided with a screw hole into which a screw is threaded, wherein said attracted member is fixed to said mounting surface by said screw being threaded into said screw hole through said opening, and wherein the mounting position of said attracted member on said mounting surface in the crossing direction is adjustable within a length of said opening in the crossing direction.

3. A holding device according to claim 1, wherein said attracted member has a surface opposed to the surface of said magnet, and the surface of said magnet and the surface of said attracted member are substantially parallel with each other.

4. A holding device according to claim 1, wherein said attracted member has a surface facing the surface of said magnet, and wherein the crossing direction is a vertical direction, and wherein the surface of each of said magnet and said attracted member faces one of upward and downward in the vertical direction, the surface of said attracted member facing a direction opposite to the facing direction of the surface of said magnet in the vertical direction.

5. A holding device according to claim 1, wherein said attracted member has a surface facing the surface of said magnet, wherein said holding device includes two closed state maintaining mechanisms which are disposed at different positions with respect to the crossing direction, and wherein the surface of said magnet of one of said closed state maintaining mechanisms and the surface of said magnet of the other closed state maintaining mechanism face opposite to each other in the crossing direction.

6. A holding device according to claim 5, wherein the crossing direction is the vertical direction.

7. A holding device comprising:

a main assembly including an outer casing having a cover;

an open/close member rotatably mounted on said main assembly at a position adjacent to said cover to open and close said main assembly; and a closed state maintaining mechanism including:

a magnet mounted, at a mounting position, on a mounting surface of one of said main assembly and said open/close member; and an attracted member provided on the other one of said main assembly and said open/close member;

wherein said attracted member has a surface facing said magnet to maintain a closed state of said open/close member relative to said main assembly by said magnet attracting and contacting said attracted member, wherein the mounting position of said magnet is adjustable between a plurality of positions, said magnet being adjustable in a crossing direction, the crossing direction being a direction (i) crossing a direction which is perpendicular to the surface of said attracted member and (ii) crossing a direction which is perpendicular to the mounting surface, and wherein said mounting surface is inclined relative to the surface of said attracted member such that a relative positional relation between said cover and said open/close member in the closed state is different based on the mounting position of said magnet.

8. A holding device according to claim 7, wherein said magnet is provided with an opening elongated in the crossing direction, and said mounting surface is provided with a screw hole into which a screw is threaded, wherein said magnet is fixed to said mounting surface by said screw being threaded into said screw hole through said opening, and wherein the mounting position of said magnet on said mounting surface in the crossing direction is adjustable within a length of said opening in the crossing direction.

9. A holding device according to claim 7, wherein said magnet has a surface opposed to the surface of said attracted member, and the surface of said attracted member and the surface of said magnet are substantially parallel with each other.

10. A holding device according to claim 7, wherein said magnet has a surface facing the surface of said attracted member, and wherein the crossing direction is a vertical direction, and wherein the surface of each of said magnet and said attracted member faces one of upward and downward in the vertical direction, the surface of said magnet facing a direction opposite to the facing direction of the surface of said attracted member in the vertical direction.

11. A holding device according to claim 7, wherein said magnet has a surface facing the surface of said attracted member, wherein said holding device includes two closed state maintaining mechanisms which are disposed at different positions with respect to the crossing direction, and wherein the surface of said attracted member of one of said closed state maintaining mechanisms and the surface of said attracted member of the other closed state maintaining mechanism face opposite to each other in the crossing direction.

12. A holding device according to claim 11, wherein the crossing direction is the vertical direction.

13. A holding device comprising:

a main assembly including an outer casing having a cover;

an open/close member rotatably mounted on said main assembly at a position adjacent to said cover to open and close said main assembly; and a closed state maintaining mechanism including:

a magnet provided on one of said main assembly and said open/close member; and an attracted member mounted, at a mounting position, on a mounting surface of the other one of said main assembly and said open/close member, wherein said magnet has a surface facing said attracted member to maintain a closed state of said open/close member relative to said main assembly by said magnet attracting and contacting said attracted member, wherein said mounting surface is (i) inclined relative to the surface of said magnet and (ii) non-parallel with a rotation axis direction of said open/close member, and wherein the mounting position of said attracted member relative to said mounting surface is adjustable in at least one of an up direction and a down direction on said mounting surface.

14. A holding device according to claim 13, wherein said attracted member is provided with an opening elongated in the rotation axis direction, and said mounting surface is provided with a screw hole into which a screw is threaded, wherein said attracted member is fixed to said mounting surface by said screw being threaded into said screw hole through said opening, and wherein the mounting position of said attracted member on said mounting surface in the rotation axis direction is adjustable within a length of said opening in the rotation axis direction.

15. A holding device according to claim 13, wherein said attracted member has a surface opposed to the surface of said magnet, and the surface of said magnet and the surface of said attracted member are substantially parallel with each other.

16. A holding device according to claim 13, wherein said attracted member has a surface facing the surface of said magnet, wherein said holding device includes two such closed state maintaining mechanisms which are disposed at different positions with respect to the rotation axis direction, and wherein the surface of said magnet of one of said closed state maintaining mechanisms and the surface of said magnet of the other closed state maintaining mechanism face opposite to each other in the rotation axis direction.

17. A holding device according to claim 16, wherein the rotation axis direction is the vertical direction.

18. A holding device comprising:

a main assembly including a cover constituting an outer casing;

an open/close member rotatably mounted on said main assembly at a position adjacent to said cover to open and close said main assembly; and a closed state maintaining mechanism including:

a magnet mounted, at a mounting position, on a mounting surface of one of said main assembly and said open/close member; and an attracted member provided on the other one of said main assembly and said open/close member, wherein said attracted member has a surface facing said magnet to maintain a closed state of said open/close member relative to said main assembly by said magnet attracting and contacting said attracted member, wherein said mounting surface is (i) inclined relative to the surface of said attracted member and (ii) non-parallel with a rotation axis direction of said open/close member, and wherein the mounting position of wherein said magnet relative to said mounting surface is adjustable in at least one of an up direction and a down direction on said mounting surface.

19. A holding device according to claim 18, wherein said magnet is provided with an opening elongated in the rotation axis direction, and said mounting surface is provided with a screw hole into which a screw is threaded, wherein said magnet is fixed to said mounting surface by said screw being threaded into said screw hole through said opening, and wherein the mounting position of said magnet on said mounting surface in the rotation axis direction is adjustable within a length of said opening in the rotation axis direction.

20. A holding device according to claim 18, wherein said magnet has a surface opposed to the surface of said attracted member, and the surface of said attracted member and the surface of said magnet are substantially parallel with each other.

21. A holding device according to claim 18, wherein said magnet has a surface facing the surface of said attracted member, wherein said holding device includes two such closed state maintaining mechanisms which are disposed at different positions with respect to the rotation axis direction, and wherein the surface of said attracted member of one of said closed state maintaining mechanisms and the surface of said attracted member of the other closed state maintaining mechanism face opposite to each other in the rotation axis direction.

22. A holding device according to claim 18, wherein the rotation axis direction is the vertical direction.

23. A holding device comprising:

a main assembly;

an open/close member rotatably provided on said main assembly to open and close said main assembly; and a closed state maintaining mechanism including:

a magnet provided on one of said main assembly and said open/close member; and an attracted member mounted, at a mounting position, on a mounting surface of the other one of said main assembly and said open/close member, wherein said magnet has a surface facing said attracted member to maintain a closed state of said open/close member relative to said main assembly by said magnet attracting and contacting said attracted member, wherein the mounting position of said attracted member is adjustable between a plurality of positions, said attracted member being adjustable in a crossing direction, the crossing direction being a direction (i) crossing a direction which is perpendicular to the surface of said magnet and (ii) crossing a direction which is perpendicular to the mounting surface, and wherein said mounting surface is inclined relative to the surface of said magnet such that a relative positional relation between said main assembly and said open/close member in the closed state is different based on the mounting position of said attracted member.

24. A holding device according to claim 23, wherein said attracted member is provided with an opening elongated in the crossing direction, and said mounting surface is provided with a screw hole into which a screw is threaded, wherein said attracted member is fixed to said mounting surface by said screw being threaded into said screw hole through said opening, and wherein the mounting position of said attracted member on said mounting surface in the crossing direction is adjustable within a length of said opening in the crossing direction.

25. A holding device according to claim 23, wherein said attracted member has a surface opposed to the surface of said magnet, and the surface of said magnet and the surface of said attracted member are substantially parallel with each other.

26. A holding device according to claim 23, wherein said attracted member has a surface facing the surface of said magnet, wherein the crossing direction is a vertical direction, and wherein the surface of each of said magnet and said attracted member faces one of upward and downward in the vertical direction, the surface of said attracted member facing a direction opposite to the facing direction of the surface of said magnet in the vertical direction.

27. A holding device according to claim 23, wherein said attracted member has a surface facing the surface of said magnet, wherein said holding device includes two closed state maintaining mechanisms which are disposed at different positions with respect to the crossing direction, and wherein the surface of said magnet of one of said closed state maintaining mechanisms and the surface of said magnet of the other closed state maintaining mechanism face opposite to each other in the crossing direction.

28. A holding device according to claim 27, wherein the crossing direction is the vertical direction.

29. A holding device comprising:

a main assembly;

an open/close member rotatably provided on said main assembly to open and close said main assembly; and a closed state maintaining mechanism including:

a magnet mounted, at a mounting position, on a mounting surface of one of said main assembly and said open/close member; and an attracted member provided on the other one of said main assembly and said open/close member;

wherein said attracted member has a surface facing said magnet to maintain a closed state of said open/close member relative to said main assembly by said magnet attracting and contacting said attracted member, wherein the mounting position of said magnet is adjustable between a plurality of positions, said magnet being adjustable in a crossing direction, the crossing direction being a direction (i) crossing a direction which is perpendicular to the surface of said attracted member and (ii) crossing a direction which is perpendicular to the mounting surface, and wherein said mounting surface is inclined relative to the surface of said attracted member such that a relative positional relation between said main assembly and said open/close member in the closed state is different based on the mounting position of said magnet.

30. A holding device according to claim 29, wherein said magnet is provided with an opening elongated in the crossing direction, and said mounting surface is provided with a screw hole into which a screw is threaded, wherein said magnet is fixed to said mounting surface by said screw being threaded into said screw hole through said opening, and wherein the mounting position of said magnet on said mounting surface in the crossing direction is adjustable within a length of said opening in the crossing direction.

31. A holding device according to claim 29, wherein said magnet has a surface opposed to the surface of said attracted member, and the surface of said attracted member and the surface of said magnet are substantially parallel with each other.

32. A holding device according to claim 29, wherein said magnet has a surface facing the surface of said attracted member, and wherein the crossing direction is a vertical direction, and wherein the surface of each of said magnet and said attracted member faces one of upward and downward in the vertical direction, the surface of said magnet facing a direction opposite to the facing direction of the surface of said attracted member in the vertical direction.

33. A holding device according to claim 29, wherein said magnet has a surface facing the surface of said attracted member, wherein said holding device includes two closed state maintaining mechanisms which are disposed at different positions with respect to the crossing direction, and wherein the surface of said attracted member of one of said closed state maintaining mechanisms and the surface of said attracted member of the other closed state maintaining mechanism face opposite to each other in the crossing direction.

34. A holding device according to claim 33, wherein the crossing direction is the vertical direction.

* * * * *